US005092374A

United States Patent [19]

Riolet et al.

[11] Patent Number: 5,092,374

[45] Date of Patent: Mar. 3, 1992

[54] GUIDE AND SUPPORT DEVICES FOR WEFT INSERTERS IN SHUTTLELESS LOOMS

[75] Inventors: Christian Riolet, Saint-Chef, France; Giuseppe Casarotto, Bergamo, Italy

[73] Assignee: S.A. Saurer Diederichs, Bourgoin Jallieu, France

[21] Appl. No.: 534,929

[22] Filed: Jun. 7, 1990

[30] Foreign Application Priority Data

Jun. 9, 1989 [FR] France ..... 89 08142

[51] Int. Cl.[5] ..... D03D 47/18

[52] U.S. Cl. ..... 139/446; 139/188 R

[58] Field of Search ..... 139/446, 188 R, 443, 139/444, 445, 447, 448

[56] References Cited

U.S. PATENT DOCUMENTS

| | | | |
|---|---|---|---|
| 3,678,968 | 7/1972 | Juillard | 139/446 |
| 4,076,053 | 2/1978 | Genini | 139/449 |
| 4,515,185 | 5/1985 | Windischbayer | 139/446 |
| 4,558,722 | 12/1985 | Gehring et al. | 139/445 X |
| 4,655,263 | 4/1987 | Dornier et al. | 139/446 |

*Primary Examiner*—Andrew M. Falik

*Attorney, Agent, or Firm*—Herbert Dubno; Andrew Wilford

[57] ABSTRACT

A shuttleless loom has a pair of inserters each having a head provided with a respective weft-yarn gripper and movable from respective sides of a warp therethrough to an advanced position in a central warp region with a weft yarn held in the gripper of a one of the inserters and a mechanism effective on the grippers in the central region to open the gripper of the one inserter and thereby transfer the yarn held thereby to the gripper of the other inserter so that the other inserter can pull the weft yarn the rest of the way through the warp. A support and guide system for the inserters has respective guide and support elements in the central region for the inserters laterally and longitudinally engaging same and forming at least one support surface positioned underneath the head of the respective inserter, and respective deflectors on the elements for spreading the warp at the support surfaces so that the warp does not come between the heads and the respective support surfaces.

6 Claims, 2 Drawing Sheets

GUIDE AND SUPPORT DEVICES FOR WEFT INSERTERS IN SHUTTLELESS LOOMS

FIELD OF THE INVENTION

The present invention relates to a shuttleless loom. More particularly this invention concerns a guide and support system for the weft inserters of such a loom.

BACKGROUND OF THE INVENTION

A standard shuttleless loom is provided with a pair of longitudinally moving weft inserters formed as lances or ribbons that move between the upper and lower shed-defining parts of the warp to pass the weft filament therethrough. These inserters are supported longitudinally, which direction is parallel to the weft and perpendicular to the warp, and laterally. Each such inserter has an inner end provided with a gripper and the two inserters are oppositely but synchronously reciprocated so that the weft yarn held in the gripper of one of the inserters and pulled thereby along the shed to the center of the warp can be released by this one inserter and taken up by the gripper of the other inserter which in turn will pull it the rest of the way through the shed formed in the warp.

As described in U.S. Pat. No. 4,515,185 the grippers are synchronously opened and closed in an exchange zone in the middle of the warp by a lever mechanism that engages the head of each of the inserters where the respective grippers are mounted. The inserters themselves are supported on guide blocks or plates distributed along the width of the fabric being woven. The known system has the main disadvantage that in the middle exchange zone where a support plate receives the opening effort of the gripper exerted by the operating lever, the lower warp filaments are pinched which risks damaging them. It is also possible to verify with this known system that certain parts wear excessively, in particular the inserters where they contact the support and guide elements.

OBJECTS OF THE INVENTION

It is therefore an object of the present invention to provide an improved guide and support system for a shuttleless loom.

Another object is the provision of such an improved guide and support system for a shuttleless loom which overcomes the above-given disadvantages, that is which takes up the force that opens the grippers in the middle of the warp, that protects the warp filaments from damage, and that reduces wear of the inserter elements.

SUMMARY OF THE INVENTION

The instant invention is used in a shuttleless loom wherein a pair of inserters each having a head provided with a respective weft-yarn gripper are movable from respective sides of a warp therethrough to an advanced position in a central warp region with a weft yarn held in the gripper of a one of the inserters and wherein a mechanism is effective on the grippers in the central region to open the gripper of the one inserter and thereby transfer the yarn held thereby to the gripper of the other inserter so that the other inserter can pull the weft yarn the rest of the way through the warp. According to the invention a support and guide system for the inserters comprises respective guide and support elements in the central region for the inserters laterally and longitudinally engaging same and forming at least one support surface positioned underneath the head of the respective inserter, and respective deflectors on the elements for spreading the warp at the support surfaces so that the warp does not come between the heads and the respective support surfaces.

Thus the force exerted on the inserters to open the respective grippers does not have to be resisted by the inserters themselves; instead it is taken up by the support surfaces. The warp yarns or filaments are deflected away from the region between these support surfaces and the inserters so that they are not pinched and damaged at this location.

According to a feature of this invention each element is formed as a hook laterally engaging a respective edge of the respective inserter and is provided with the respective support surface. In addition each support surface is formed by a respective metallic carbide plate secured to the respective hook and each deflector is formed on the respective hook.

In accordance with the invention at least two such hooks are provided for each inserter which each have a pair of opposite edges each engaged by a respective one of the hooks and the hooks of each inserter are longitudinally offset from each other. The support surfaces are positioned underneath central regions of the respective heads in the advanced positions of same.

DESCRIPTION OF THE DRAWING

The above and other objects, features, and advantages will become more readily apparent from the following, reference being made to the accompanying drawing in which.

SPECIFIC DESCRIPTION

Figure 1:
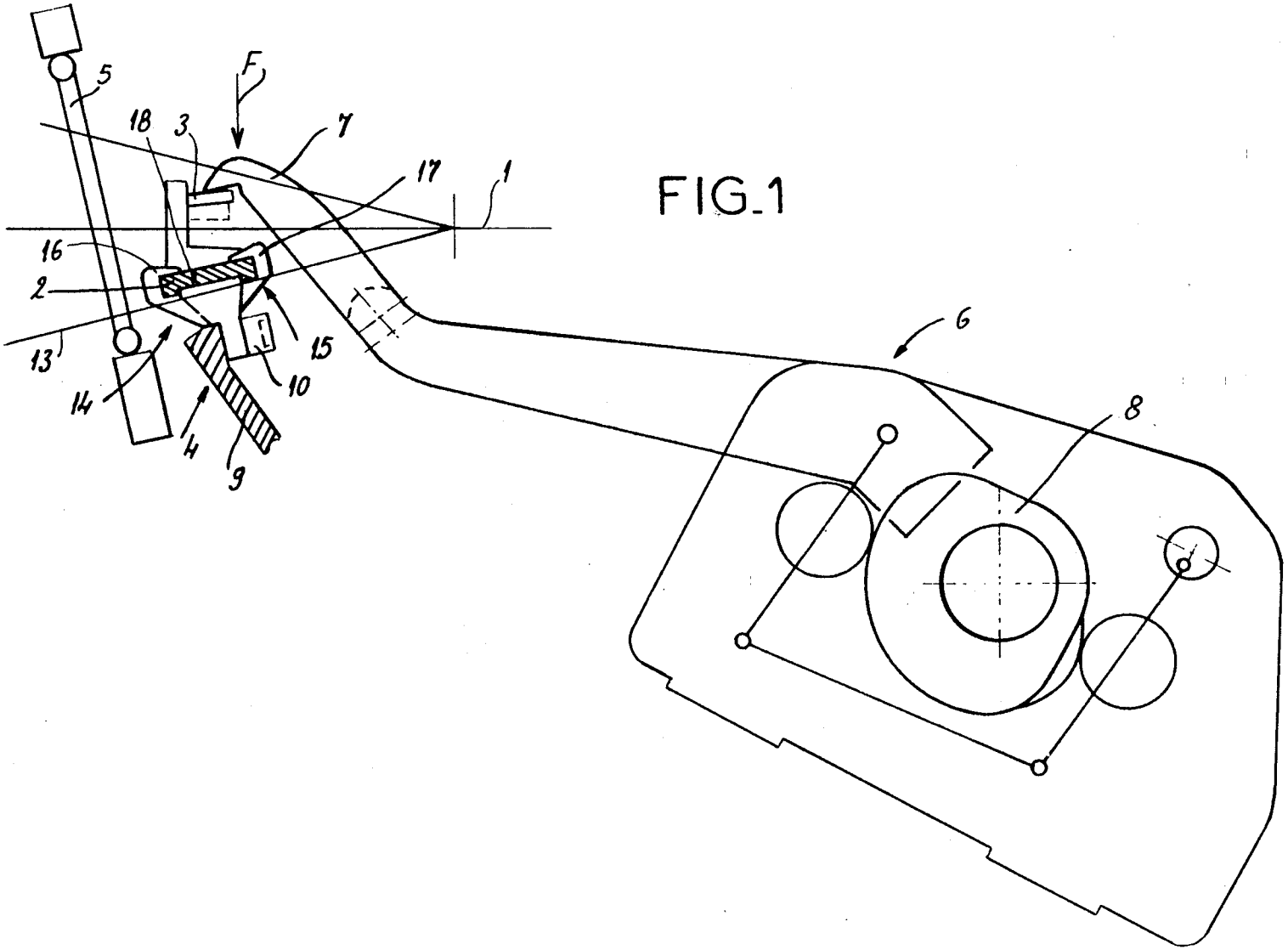
FIG. 1 is a side view, partly diagrammatic and partly in vertical section, through the system of this invention.

As seen in FIG. 1 a shuttleless loom has inserter bars 2 (see FIG. 3) which can move from respective sides of the warp 1 through a shed in same to pass a weft filament therethrough, with one of the inserters 2 moving the end of the weft yarn to the center of the warp 1 where it is passed to the other inserter that in turn draws it the rest of the way through. Each inserter 2 is constituted as a needle or metal ribbon whose inner end or head carries a gripper 3 adapted to hold the weft yarn being inserted. The inserters 2 are supported and longitudinally guided in elements shown generally at 4. The loom also has a reed 5 and a mechanism 6 for opening the grippers 3 at the middle of the warp 1 where the weft yarn is passed from one inserter 2 to the other. As seen in FIG. 1 the mechanism 6 for opening the grippers 3 can comprise for each gripper 3 a lever 7 itself operated by a cam 8 as is known, for example, from U.S. Pat. No. 4,515,185.

Figure 2:
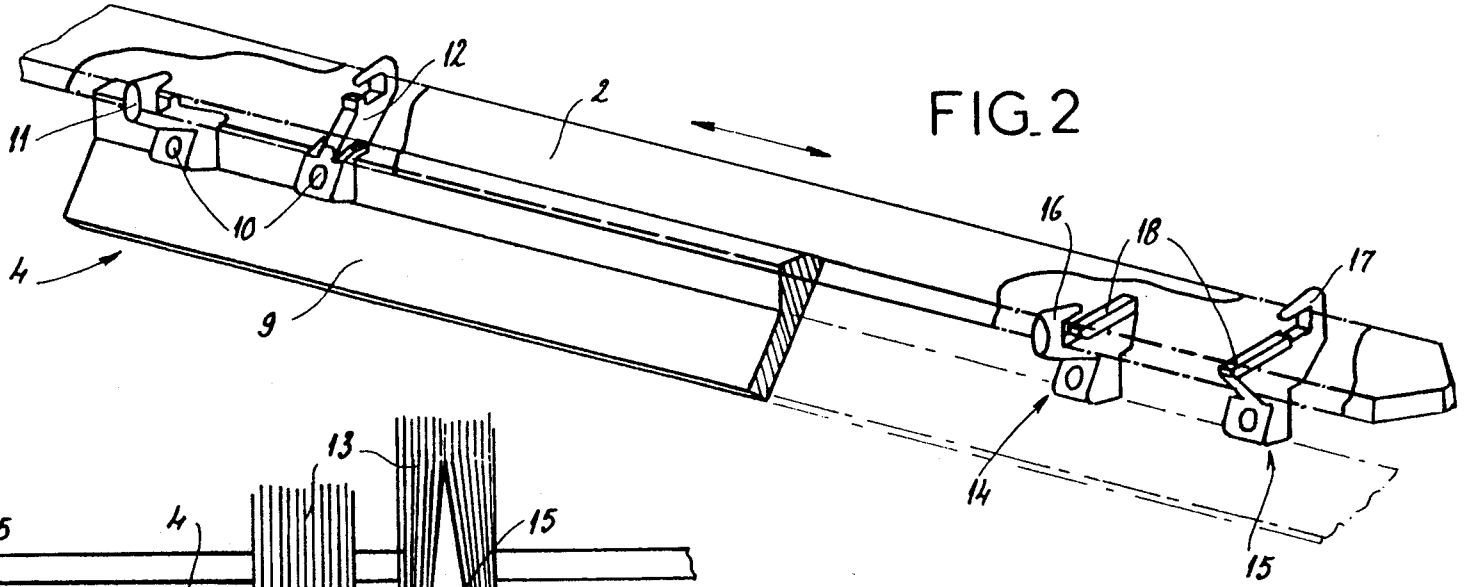
FIG. 2 is an isometric view showing the support and guide elements of the inserter according to this invention, some parts being removed or broken away for clarity of view.

The guide and support elements 4 shown in more detail in FIG. 2 comprise a crosswise support bar 9 which extends along the entire width of the warp 1. Outside the central region of the warp 1 are guide hooks 11 and 12 secured in place by screws 10, with the hooks 11 on one edge of the bar 9 and the hooks 12 on the other staggered relative to the hooks 11. These guides 11 and 12 permit the inserters 2 to pass above the warp yarns 13 in the lower part of the shed in such a manner that the inserters or their heads never touch the filaments 13 or the reed 5 at any time. In addition the lateral guides 11 and 12 are themselves constructed so as not to catch the warp filaments 13.

In the central region of the warp 1 where the weft yarn is passed from one inserter 2 to the other there are special guide/support elements 14 and 15 instead of the hooks 11 and 12. In this region and where it lies above the hooks 11 and 12 the inserter 2 is shown in dot-dash lines for clarity of view. These elements 14 and 15 have respective hooks 16 and 17 that serve to reach over and laterally guide the respective edge of the respective inserter 2 and a support surface 18 underneath the respective inserter 2 when its head is in the central region of the warp 1. More particularly, the support surface is situated underneath the central portion of the inserter 2 when same is advanced into the position illustrated in FIG. 3, that is underneath the part toward the center of this element 2, not adjacent its edges. The support surface 18 can be formed by a small plate or bar of metallic carbide fixed to the respective guide hook 14 or 15 which itself is made of treated steel.

Figure 3:
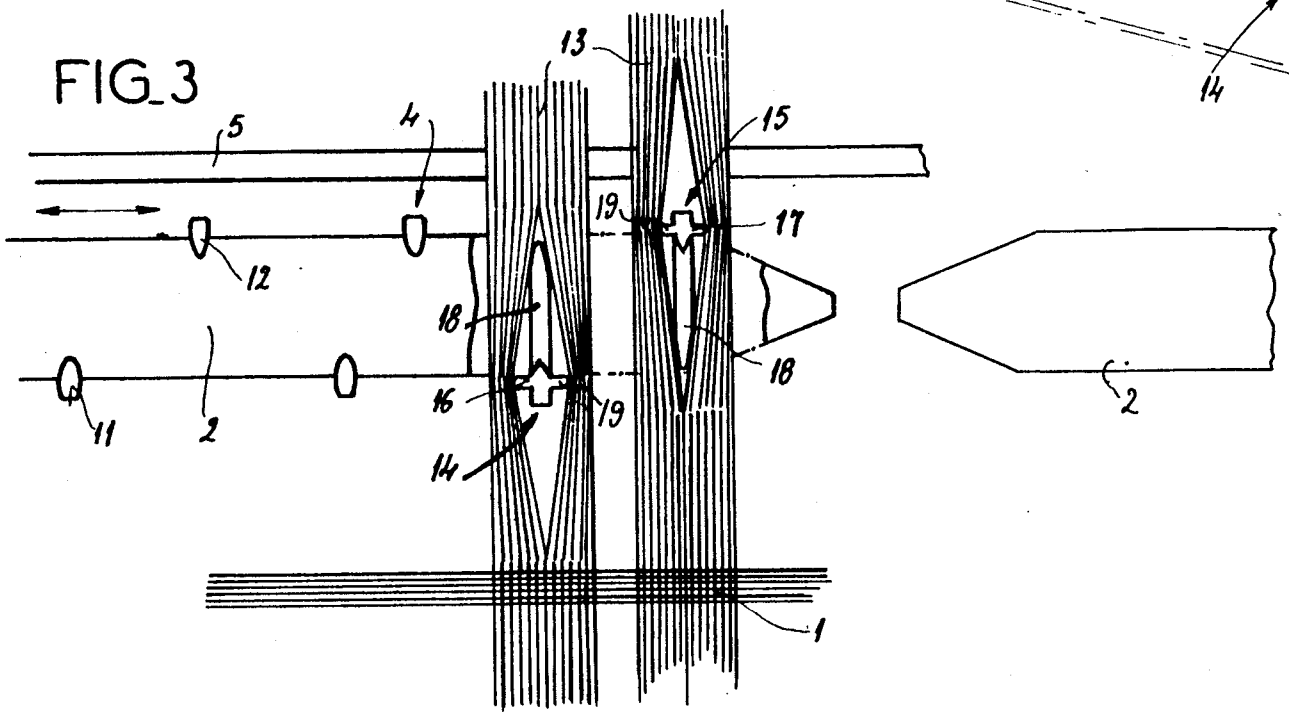
FIG. 3 is a top view showing how the system of this invention functions with once again some parts removed or broken away for clarity of view.

As the weft filament is exchanged from one inserter to the other the heads of the inserters 2 are level with the support and guide elements 14 and 15 described above. When the lever 7 engages the respective gripper 3 in the direction shown by arrow F of FIG. 1 the pressure is taken up by the support surfaces 18 which easily resist the opening force of the respective grippers 3. In addition this takes place without any chance of damaging the filaments 13 of the lower part of the shed since as seen in FIG. 3 same are parted by deflectors 19 formed on the hooks 16 and 17 of the support elements 14 and 15.

How many of these support and guide elements 14 and 15 are provided depends on how large the region affected by the gripper-opening forces is.

The metallic carbide plates forming the support surface aid sliding of the inserters 2 while simultaneously avoiding wear of these elements 2 from friction. In any case these separate plates are optional and it is equally possible to make the guide and support elements 14 and 15 of one piece with support surfaces 18 formed integrally and provided with a hard low-friction coating.

The instant invention is not limited to the above-given embodiment, but instead is covered by the scope of the following claims. For instance the inserters could be needles or telescoping, or could be formed of bendable ribbons.

We claim:

1. In a shuttleless loom wherein a pair of inserters each having a head provided with a respective weft-yarn gripper are movable from respective sides of a warp therethrough to an advanced position in a central warp region with a weft yarn held in the gripper of a one of the inserters;

a mechanism is effective on the grippers in the central region to open the gripper of the one inserter and thereby transfer the yarn held thereby to the gripper of the other inserter so that the other inserter can pull the weft yarn the rest of the way through the warp, a support and guide system for the inserters comprising:

respective guide and support elements in the central region for the inserters laterally and longitudinally engaging same and forming at least one support surface positioned underneath the head of the respective inserter; and respective deflectors on the elements for spreading the warp at the support surfaces so that the warp does not come between the heads and the respective support surfaces.

2. The support and guide system for a shuttleless loom as defined in claim 1 wherein each element is formed as a hook laterally engaging a respective edge of the respective inserter and is provided with the respective support surface.

3. The support and guide system for a shuttleless loom as defined in claim 2 wherein each support surface is formed by a respective metallic carbide plate secured to the respective hook.

4. The support and guide system for a shuttleless loom as defined in claim 2 wherein each deflector is formed on the respective hook.

5. The support and guide system for a shuttleless loom as defined in claim 2 wherein at least two such hooks are provided for each inserter, each inserter having a pair of opposite edges each engaged by a respective one of the hooks and the hooks of each inserter being longitudinally offset from each other.

6. The support and guide system for a shuttleless loom as defined in claim 1 wherein the support surfaces are positioned underneath central regions of the respective heads in the advanced positions of same.

* * * * *